US008695558B2

(12) United States Patent
Reymond et al.

(10) Patent No.: US 8,695,558 B2
(45) Date of Patent: Apr. 15, 2014

(54) CYLINDER SLEEVE FOR AN INTERNAL COMBUSTION ENGINE AND BLOCK OF CYLINDERS WHICH ARE EQUIPPED WITH ONE SUCH SLEEVE

(75) Inventors: Joseph Reymond, Munich (DE); Alain Noblet, Belmont (FR); Francois Rochat, Roquevaire (FR); Andreas Blum, Munich (DE); Eckard Puschel, Marzling (DE); Andreas Fischersworring-Bunk, Munich (DE); Ulrich Gutzer, Munich (DE)

(73) Assignees: Peugeot Citroen Automobiles SA, Velizy Villacoublay (FR); Bayerische Motoren Werke Aktiengesellschaft, Munich (DE)

( * ) Notice: Subject to any disclaimer, the term of this patent is extended or adjusted under 35 U.S.C. 154(b) by 806 days.

(21) Appl. No.: 11/993,845

(22) PCT Filed: Jun. 28, 2006

(86) PCT No.: PCT/FR2006/001504

§ 371 (c)(1),
(2), (4) Date: Jun. 18, 2010

(87) PCT Pub. No.: WO2007/003761

PCT Pub. Date: Jan. 11, 2007

(65) Prior Publication Data

US 2010/0263619 A1 Oct. 21, 2010

(30) Foreign Application Priority Data

Jun. 29, 2005 (FR) ..... 05 06654

(51) Int. Cl.
*F02F 1/00* (2006.01)

(52) U.S. Cl.
USPC ..... 123/193.2; 123/41.74; 123/41.82 R; 123/41.31

(58) Field of Classification Search
USPC ..... 123/193.2, 41.74, 41.82 R, 41.31
See application file for complete search history.

(56) References Cited

U.S. PATENT DOCUMENTS 4,561,388 A * 12/1985 Gwinner et al. ..... 123/41.74
4,846,116 A * 7/1989 Sakurahara et al. ..... 123/41.74
4,903,652 A * 2/1990 Field et al. ..... 123/193.2

(Continued)

FOREIGN PATENT DOCUMENTS

DE 10018730 A1 10/2001
DE 10146850 A1 * 1/2003

(Continued)

OTHER PUBLICATIONS

International Search Report mailed Oct. 30, 2006 in PCT/FR2006/001504.

*Primary Examiner* — Marguerite McMahon
*Assistant Examiner* — James Kim
(74) *Attorney, Agent, or Firm* — Nicolas E. Seckel

(57) ABSTRACT

The invention relates to a cylinder sleeve (2) for lining the cylindrical wall of a cylinder (A1) of an internal combustion engine. The inventive sleeve (2) comprises an inner wall (3) which is intended to guide a piston in translation and an outer wall (4) which is intended to rest on the cylindrical wall of the cylinder. The outer wall (4) of the sleeve of the cylinder (2) comprises an upper part (6) which is flared toward a top edge (5) of the sleeve (2), which is defined between the inner (3) and outer (4) walls of the cylinder sleeve. The invention also relates to a cylinder block of an internal combustion engine, comprising at least two cylinders (A1, B1) which are each equipped with one such cylinder sleeve.

13 Claims, 2 Drawing Sheets

(56) References Cited

U.S. PATENT DOCUMENTS

Figures 1, 2, 4, 5, 6:
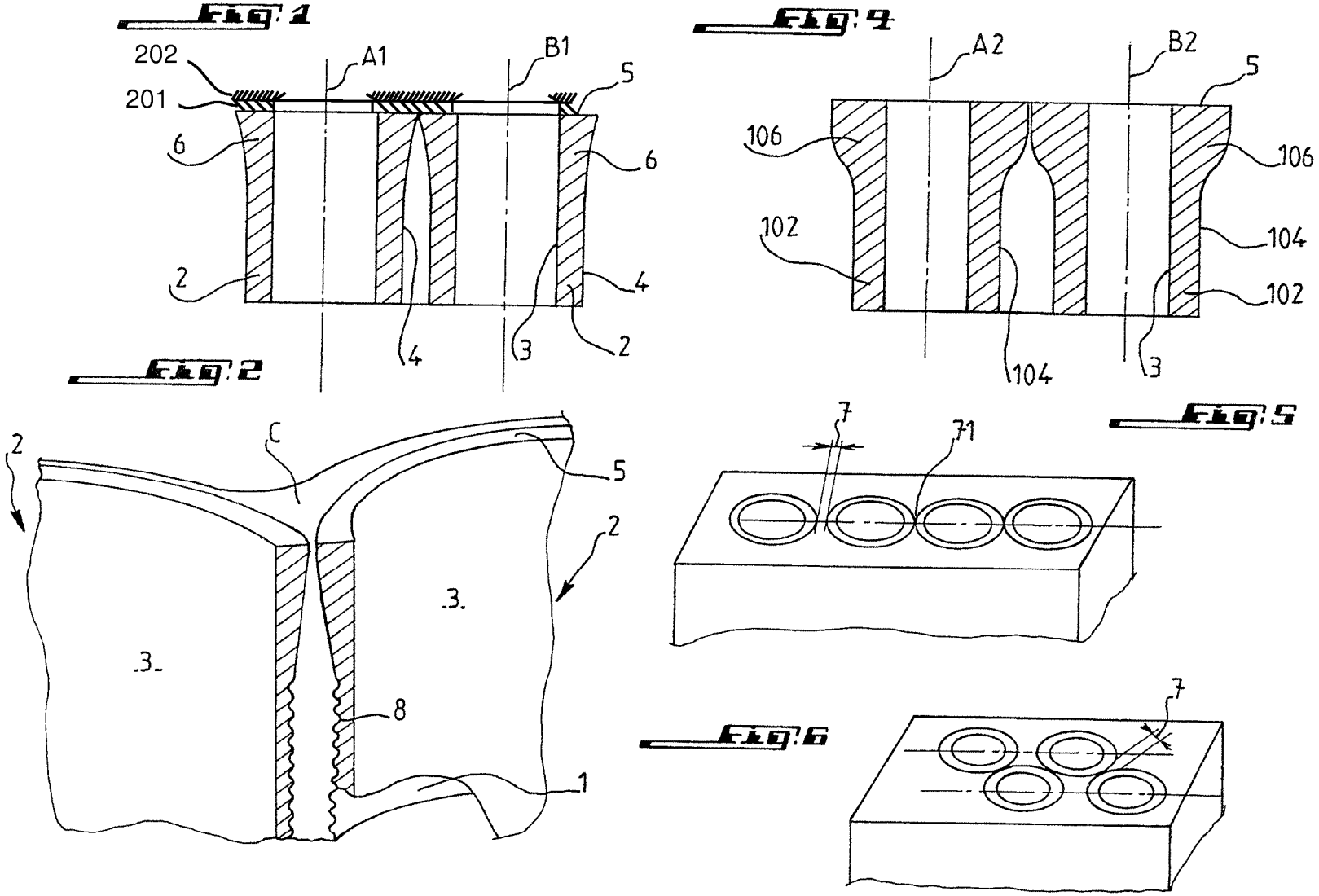

| | | | | |
|---|---|---|---|---|
| 4,974,569 | A * | 12/1990 | Ampferer et al. | 123/193.2 |
| 5,732,671 | A * | 3/1998 | Takami et al. | 123/193.2 |
| 6,202,603 | B1 * | 3/2001 | Etemad | 123/41.74 |
| 6,640,765 | B2 * | 11/2003 | Land et al. | 123/193.2 |
| 6,662,773 | B2 * | 12/2003 | Bauder | 123/193.2 |
| 7,059,290 | B2 * | 6/2006 | Ishikawa et al. | 123/193.2 |
| 7,234,433 | B2 * | 6/2007 | Liebert | 123/193.5 |
| 2003/0051713 | A1 * | 3/2003 | Bedwell et al. | 123/668 |
| 2005/0072395 | A1 * | 4/2005 | Bilger et al. | 123/195 R |
| 2005/0150476 | A1 * | 7/2005 | Gohrbandt et al. | 123/193.2 |

FOREIGN PATENT DOCUMENTS

| | | | |
|---|---|---|---|
| DE | 10338979 | A1 | 3/2005 |
| JP | 59096457 | A | 6/1984 |
| WO | WO 9741340 | A | 6/1997 |

* cited by examiner

A1
B1
A2
B2
202
201
1
2
3
4
5
6
7
7'
8
102
104
106
C

CYLINDER SLEEVE FOR AN INTERNAL COMBUSTION ENGINE AND BLOCK OF CYLINDERS WHICH ARE EQUIPPED WITH ONE SUCH SLEEVE

The invention concerns a cylinder sleeve for lining the cylindrical wall of a cylinder of an internal combustion engine, as well as a cylinder block of an internal combustion engine having at least one cylinder equipped with such a cylinder sleeve.

In its most general form, an internal combustion engine, or heat engine, includes an engine block in which at least one cylinder is formed, inside which a piston is movably mounted and connected to a crankshaft by a connecting element such as a rod. The engine block comprises three main parts, one of which is called a cylinder block, as it has one or more cylinders. For the remainder of the document, the single spelling "cylinder block" is used for the French "bloc cylindres", which does not exclude single-cylinder engines from the invention.

The cylinder block is covered on one side with a cylinder head (the second main part), in which the means necessary for internal combustion are arranged: in particular, intake means, exhaust means and optional ignition means. On the other side, the cylinder block is covered with an engine crankcase in which a crankshaft (the third main part) is housed.

When the combustion engine is the linear-motion piston type, as opposed to a rotary piston engine, the engine block has at least one cylinder enclosed by a straight cylindrical wall, inside which a piston can move translationally, connected to the crankshaft by a rod. The cylinder head comprises the distribution means for the cylinder or for each of the cylinders: for example, at least one intake valve, at least one exhaust valve, and an optional spark plug, as well as mechanical means for controlling the valves. And the engine crankcase contains the crankshaft and the rod and the oil reservoir needed to lubricate the engine.

Gaskets are used to form a seal between the three main parts of the combustion engine: namely, between the cylinder block and the cylinder head, and between the cylinder block and the engine crankcase. More specifically, the upper seal—i.e., the seal between the cylinder block and the cylinder head—is formed by a cylinder head gasket developed specifically for this purpose.

No matter what mode of operation such an internal combustion engine uses—i.e., two-stroke or four-stroke, compression ignition or spark ignition—this operation will always include the following stages for each of the cylinders: an intake of a fuel and the air needed for combustion, a compression of the fuel/air mixture, an internal combustion of the fuel/air mixture, and an exhausting of the combusted fuel. These four stages are organized into two or four cycles by using an appropriate combustion engine architecture.

It is easy to understand why the design of the internal combustion engine and the choice of material from which it is made are primarily determined by the stresses to which the engine is subjected during the combustion stage, which is a true explosion.

On the other hand, a compromise is sought between an engine that is resistant enough to the static and dynamic stresses to which it is exposed during its operation and an engine that is as light as possible. Taking into account the engine's ability to withstand static stresses and dynamic stresses during its operation, a compromise is sought between 1) an engine that is rigid enough to be able to withstand the prestressing forces from the clamp loads of the cylinder head and crankcase, plus the expansion forces resulting from the internal combustion or explosion stages, depending on the thermodynamic cycles and 2) a flexibility or resilience to absorb expansion forces and thereby minimize deformations that could result from the forces and other stresses.

Indeed, deformations are generally related to the dynamic stresses of the thermodynamic cycles. But they are also caused by the prestressing forces from the clamp loads of the cylinder head and the head cover covering the cylinder head.

Most of the compromises found for the architecture of an internal combustion engine that incorporate both resistance to stresses and resilience to deformation has to do with a design in which the engine is made of a light alloy (generally an aluminum alloy) and each of the cylinders is equipped with a cylinder sleeve, made of a hard material, that determines the cylinder bore size.

The cylinder sleeve can be fixed or mobile, and when it is fixed, it can be durably attached inside the cylinder block or it can be removable.

The present invention relates to a cylinder sleeve that is fixed, but optionally removable, for lining the cylindrical wall of a cylinder in an internal combustion engine.

The advantage of an internal combustion engine design having a cylinder block with sleeved cylinders is to have both a light, resilient engine and rigid cylinders, especially cylinders that are hard enough to withstand the friction of the piston.

However, it has been observed that, when the cylindrical wall of a cylinder is lined with a cylinder sleeve, this produces a major problem that arises primarily at the time of the combustion stage, when the stresses from the explosion and attendant thermal changes are added to the stresses on the cylinder block from the compression forces.

Thus, the cylinder block design, as mentioned above, must address the necessity of forming a seal between the cylinder block and the cylinder head, among other requirements.

This seal is formed by means of a cylinder head gasket made of a plurality of superimposed foil sheets, for example.

In this way, the cylinder head gasket is capable of forming a seal between the cylinder block and the cylinder head with a predetermined flexibility in an axial direction of the cylinder.

However, this seal can only be completely effective when the cylinder block surface facing the surface of the cylinder head behaves more or less uniformly the whole time the engine is running.

It is easy to see that making the cylinder block out of two materials—i.e., the cylinder block itself from a light, relatively soft alloy and the cylinder sleeve(s) from a heavy, hard material—also results in different thermal behaviors for the two components of the cylinder block.

In addition, thermal behavior requires careful consideration in the design of the cylinder block, since it is more or less difficult to design the air or liquid cooling system for the cylinder block, depending on the dimensions of the cylinder block and the number of cylinders and their arrangement.

Furthermore, in many engines the top edges of the cylinder sleeves are lower than a plane determined by the contact surface between the cylinder block and the cylinder head. Consequently, in such a situation the cylinder head gasket rests primarily or even exclusively on the light metal body of the cylinder block.

Moreover, at the moment of combustion—that is, the moment the fuel explodes—the expansion of each of the cylinder sleeves produces extraordinary pressure on the bridge formed by the part of the cylinder block located between two neighboring cylinders. The compression exerted on this part of the cylinder block plays its own part in increasing the fragility of the cylinder block.

Another major drawback is the expansion of this very part that forms the bridge between two neighboring cylinders. This expansion exerts strong pressure, first of all, on the cylinder head gasket, because the metal becomes plastic in this part of the cylinder block. This expansion exerts strong pressure on the two neighboring sleeves as well, to "create" the space needed for its expansion. The resulting deformation of the cylinder sleeves is very detrimental to the contact between the inner walls of the sleeves and the corresponding pistons.

Lastly, as the engine cools, the plasticity of the metal—particularly when it is aluminum—can cause cracks to form between the sleeves and the cylinder block, which impairs the head gasket seal.

One location that is particularly subject to these stresses and is particularly critical in determining whether the cylinder block can withstand thermal stresses is the space between two neighboring cylinders.

In the traditional design of a cylinder block with at least two sleeved cylinders, the cylinder sleeves have the general shape of a straight cylindrical tube with an inner wall for guiding a piston translationally and an outer wall to be supported by the cylindrical wall of the recess that forms the cylinder. The inner and outer walls of the sleeve are substantially co-cylindrical, but not necessarily rotationally cylindrical, and they delineate between them a top edge of the sleeve intended to accommodate at least part of a head gasket.

On a cylinder block having two or more cylinders, each equipped with a cylinder sleeve, there is an alternation between less thermally conductive hard areas, formed by the cylinder sleeves, and thermally conductive softer areas formed by different parts of the body of the cylinder block. Due to the limited space available between two neighboring cylinders, it is generally impossible to insert coolant channels so as to avoid overheating the space between two neighboring cylinders during the combustion stage. This results in a high risk of cracking, which can impair the resistance of the cylinder block to operating stresses.

Another disadvantage (often a major one) is thermal expansion of the light metal—aluminum, for example—in the space between two cylinders. This exerts very strong pressure on the cylinder head gasket (the interbore area becomes plastic) and bends the sleeves in the interbore area toward the inside of the cylinder barrels, which is very detrimental to the proper piston/sleeve interaction.

The purpose of the invention is to propose a solution that makes it possible to remedy the previously listed disadvantages.

More specifically, the purpose of the invention is to propose an improvement to sleeved cylinders.

The purpose of the invention is achieved with a cylinder sleeve for lining the cylindrical wall of a cylinder of an internal combustion engine, the sleeve having an inner wall for guiding a piston translationally and an outer wall intended to be supported by the cylindrical wall of the recess that forms the cylinder, the inner and outer walls of the sleeve being substantially co-cylindrical and delineating between them a top edge of the sleeve intended to accommodate at least part of a head gasket.

In accordance with the invention, the outer wall of the cylinder sleeve comprises a top part that flares out toward the top edge of the sleeve.

This feature of the invention makes it possible both to retain the traditional design of a cylinder sleeve lining the cylindrical wall of a cylinder of an internal combustion engine with the required distances between two neighboring cylinders, and the need to obtain a maximally uniform contact surface between the cylinder block and the cylinder head.

In this design of the invention, the cylinder sleeve is a tubular element whose cross-section is no longer constant over the whole vertical length, but widens out in an annular area ending at the top edge of the sleeve, by flaring or otherwise widening the outer wall of the cylinder sleeve. With this design of the invention, the required average distance is maintained between two neighboring cylinders along most of the height of the corresponding sleeves in order to meet the technical requirements concerning the static and dynamic stability of the cylinder block in the space between two neighboring cylinders. At the same time, all space is eliminated between the cylinder sleeves of two neighboring cylinders in the plane defined by the contact surface between the cylinder block and the cylinder head, or at least this space is minimized so that, preferably, it does not exceed the order of magnitude of the manufacturing tolerances of the cylinder block.

Thus, light metal is eliminated as much as possible between the cylinders so that it no longer has any effect at the top of the cylinders. It is obviously impossible to completely eliminate all space between the sleeves, if only because of the constraints on assembling the sleeves in the machinery (tolerances).

Note that the solution proposed by the invention applies equally well to cylinders lined with a fixed sleeve as it does to cylinders equipped with a removable sleeve, since the features of the invention relate solely to the top part of the cylinder sleeve: that is, an annular portion starting at the top edge of the sleeve.

And it also applies regardless of the type of surface of the outer wall of the top part of the sleeve, whether it has striations, for example, to tighten the fit between the cylinder sleeve and the cylinder block after the cylinder block is cast, or whether it is smooth to enable the metal of the cylinder block to slide on the outer wall of the sleeve when it expands, which can even produce a "corner effect" to offset the expansion of the sleeve in its upper region, thereby guiding the piston through the sleeve better.

It is further specified that the widened top part of the cylinder sleeve can take various shapes. That is, this wider part can have a conical shape or a rounded shape that is more or less complex, depending on casting constraints or other manufacturing considerations.

Likewise, the dimensions of the widened or flared top part of the outer wall of the sleeve according to the invention are determined as a function of the radial distance between the outer walls of two cylinder sleeves for lining the cylindrical walls of two neighboring cylinders.

The top part of the sleeve can be flared in such a way that the top edges of two sleeves lining the cylindrical walls of two neighboring cylinders will define a space between them that is negligible, but present, when the engine is cold. This space decreases or disappears when the engine becomes warm.

Conversely, the top part of the sleeve can be flared in such a way that the top edges of two sleeves lining the cylindrical walls of two neighboring cylinders will be close enough to one another that there is no space between these top edges when the engine is warm. A negligible space may reappear, then, when the engine cools down.

The purpose of the invention is also achieved with a cylinder block of an internal combustion engine having at least two cylinders, each cylinder comprising a cylindrical wall lined with a cylinder sleeve that has the characteristics previously described.

This cylinder block can be engineered in such a way that the upper surface of the cylinder block is essentially free of spaces between the sleeves of neighboring cylinders, or in such a way that the upper surface of the cylinder block is free of space between two cylinder sleeves lining two neighboring cylinders, when the engine is warm.

Figure 3:
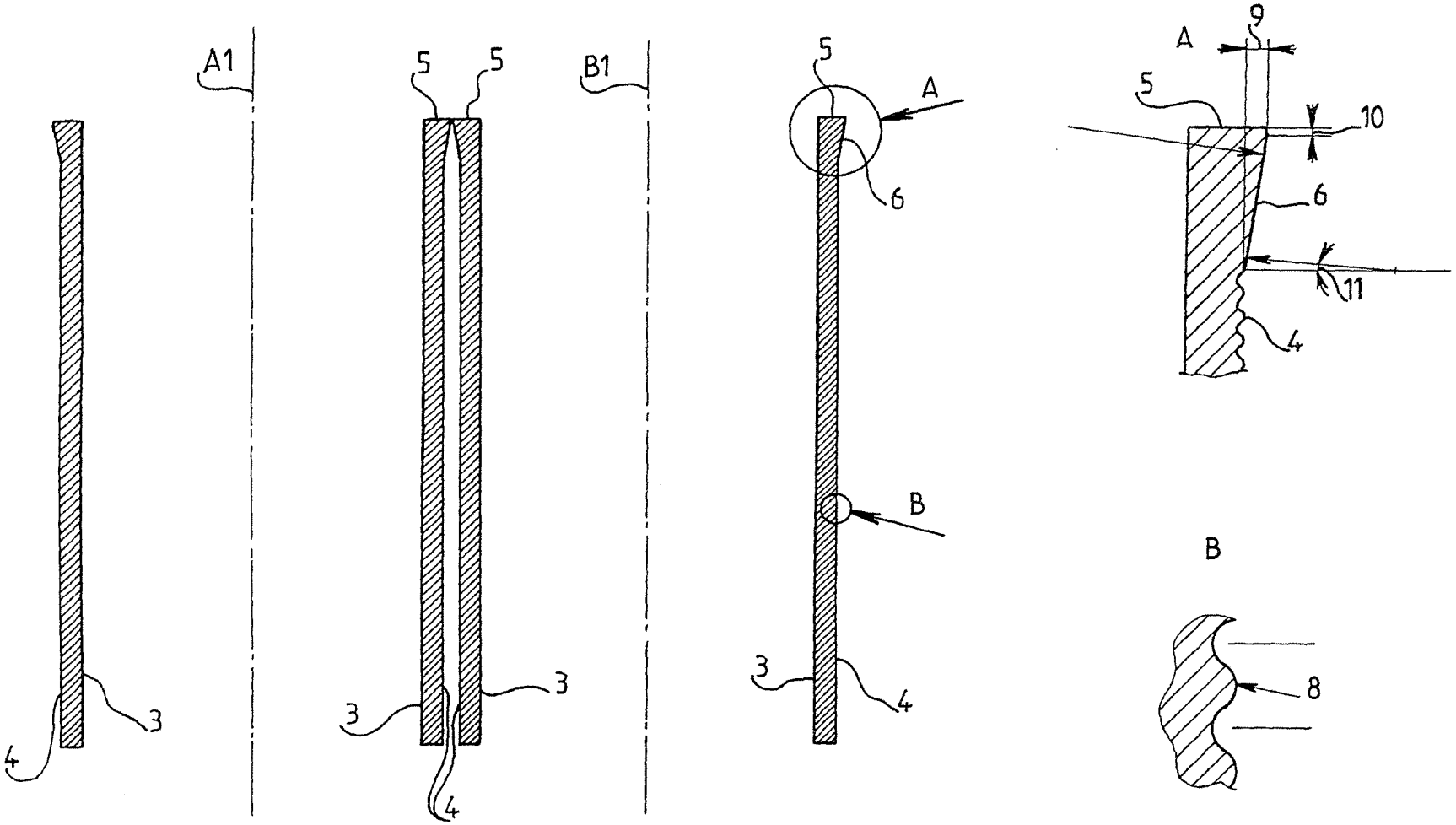

Other characteristics and advantages of the present invention will appear in the following description of an embodiment of the invention. This description is made with reference to the drawings, in which:

FIG. 1 shows an axial cross-section of two cylinder sleeves according to a first embodiment of the invention, lining two neighboring cylinders, FIG. 2 shows a partial perspective view of the cylinder sleeves in FIG. 1 lining two neighboring cylinders, FIG. 3 shows the two cylinder sleeves in FIG. 1 in more detail, FIG. 4 shows an axial cross-section of two cylinder sleeves according to a second embodiment of the invention, lining two neighboring cylinders, FIG. 5 shows a very schematic perspective view of a cylinder block with four in-line cylinders, and FIG. 6 shows a very schematic perspective view of a cylinder block with four staggered cylinders.

In the following description, reference is made to an arrangement of two cylinder sleeves according to the invention intended to line the respective cylinder walls of each of two neighboring cylinders of an internal combustion engine. It goes without saying that the number of cylinders equipped with a cylinder sleeve according to the invention in an internal combustion engine is of no importance to the principle of the present invention. The same applies to the spatial arrangement of the cylinders when the engine has three or more cylinders.

In the two embodiments of the invention described below, identical elements have the same reference number. And for corresponding elements, the reference numbers used in the first embodiment are increased by one hundred for the second embodiment.

As for the cylinders equipped with the cylinder sleeves according to the invention, two neighboring cylinders are referenced A1 and B1 for the first embodiment of the sleeve of the invention, and A2 and B2 for the second embodiment of the sleeve of the invention.

A cylinder sleeve 2 according to the first embodiment of the invention is for lining the cylindrical wall 1 of a cylinder A1 or B1 of a cylinder block C of an internal combustion engine. The sleeve 2 has an inner wall 3 for guiding a piston translationally and an outer wall 4 intended to be supported by the cylindrical wall 1 of the cylinder A1 or B1. The inner 3 and outer 4 walls of the cylinder sleeve are substantially co-cylindrical and they delineate between them a top edge 5 of the cylinder sleeve, intended to accommodate at least part of a head gasket 201 placed between the cylinder block and a cylinder head 202. The outer wall 4 of the cylinder sleeve 2 comprises a top part 6 that flares out toward the top edge 5 of the sleeve 2 such that the top part of each of the cylinder sleeves includes a concave annular section followed by a convex annular section followed by a straight annular peripheral border adjoining the top edge, each having approximately a same length, as illustrated on FIG. 4.

In accordance with the first embodiment of the invention shown in FIGS. 1 to 3, the outer wall 4 of the cylinder sleeve 2 comprises a substantially conical top part 6.

The outer wall 4 has striations 8 for tightening the fit between the cylinder block C and the sleeve 2. These striations 8 can cover the whole axial length of the sleeve all the way to the top edge 5, or the axial length of the sleeve excluding the top part 6, or these striations can be confined to an annular section of the sleeve. However, it is equally possible for the cylinder sleeve 2 not to have striations, especially when it is a removable cylinder sleeve, or conversely, for these striations to extend to the top surface of the sleeve.

The flared top part 6 of the outer wall 4 of the sleeve according to the invention is sized as a function of a radial distance 7 (see FIG. 5) between the outer walls 4 of two cylinder sleeves 2 for lining the cylindrical walls 1 of two neighboring cylinders A1, B1. In FIG. 3, the widening is referenced 9.

In accordance with what is shown in FIG. 1 as distinguished from FIGS. 2 and 3, the widening 9 of the top part 6 of the outer wall 4 of the cylinder sleeve according to the invention can be embodied with a concave shape (FIG. 1) or a strictly conical shape (FIGS. 2, 3). The widening shown in FIG. 3, detail A can be easily expressed using an angle 11 between the straight periphery of the outer wall 4 and the orientation of the conical top part 6 of the sleeve 2.

Note also that for practical reasons, it can be helpful to join the upper surface 5 to the top part 6 of the outer wall 4 of the sleeve using a non-conical peripheral rim 10. Such a feature has the advantage of a single support diameter for the head gasket after machining. When there is not a conical widening, machining is done according to manufacturing tolerances, with the result that the cylinder sleeves do not all have exactly the same support surface at the head gasket.

According to the second embodiment of the cylinder sleeve according to the invention, shown in FIG. 4, the sleeve 102 comprises an inner wall 3 for guiding a piston translationally and an outer wall 104 intended to be supported by the cylindrical wall 1 of the cylinder. The inner 3 and outer 104 walls of the cylinder sleeve 102 are substantially co-cylindrical and they delineate between them a top edge 5 of the sleeve, intended to accommodate at least part of a head gasket.

The second embodiment differs from the first primarily in the shape of the widened or flared upper part 106 or 6. In fact, to show that the flared upper part of the outer wall of the cylinder sleeve according to the invention can have any technically reasonable shape, the flared part according to FIG. 4 includes a concave annular section followed by a convex annular section, moving upward toward the top edge 5. Thus, it is an essentially continuous widening, as opposed to a discontinuous enlargement, such as an enlargement in the shape of a straight cylinder. The greatest diameter of the top part 6 or 106 is at the top edge 5 of the cylinder sleeve, in any case.

With this feature of the invention, the top edges 5 of two cylinder sleeves 2 or 102 lining the cylindrical walls 1 of two neighboring cylinders A1, B1 or A2, B2 create a negligible space 7 when the engine is cold, and make this space disappear when the engine is warm. As an exception, the lack of space 71 is referenced on the same FIG. 6.

This feature of the invention also makes it possible to establish a thermal bridge between neighboring sleeves and especially a practically continuous support surface for supporting a head gasket placed between all of the top edges 5 of the cylinder sleeves 2 and the cylinder head that covers the cylinders.

The decision on whether to embody a cylinder block with cylinder sleeves according to the invention by defining a negligible space 7 between two neighboring sleeves when the engine is cold, or by defining a lack of such a space, will depend at least in part on manufacturing tolerances that must be considered when the cylinder block is cast and by taking into account inevitable expansions of the cylinder block and the sleeves while the internal combustion engine is running.

The invention claimed is:

1. Cylinder block of an internal combustion engine having at least two cylinders, wherein each of the cylinders comprises a respective cylindrical wall lined with a respective cylinder sleeve, each of the cylinder sleeves having an inner wall for guiding a piston translationally and an outer wall intended to be supported by the cylindrical wall of the respective cylinder, the inner and outer walls of the respective cylinder sleeve being substantially co-cylindrical and delineating between them a top edge of the sleeve intended to accommodate at least part of a head gasket, wherein the outer wall of the cylinder sleeve comprises a top part that widens toward the top edge of the cylinder sleeve, wherein the outer wall of the cylinder sleeve is provided with striations, except on the widening top part of the outer wall, and wherein the widening of the top part of the cylinder sleeve is determined so that the top edges of at least two of the cylinder sleeves lining the cylindrical walls of two neighbouring cylinders among the at least two cylinders are arranged so that (i) there is a space between the top edges of the two neighbouring cylinders when the engine is cold, and (ii) there is no space between the top edges of the two neighbouring cylinder sleeves when the engine is warm, wherein the top part of each of the cylinder sleeves includes a straight annular peripheral rim adjoining the top edge of the respective cylinder sleeve.

2. Cylinder block according to claim 1, wherein the widening of the top part of the outer wall is determined as a function of the radial distance between the outer walls of two cylinder sleeves for lining the cylindrical walls of two neighbouring cylinders.

3. Cylinder block according to claim 1, wherein the widening of the top part of the cylinder sleeve is determined so that the top edges of two cylinder sleeves lining the cylindrical walls of two neighbouring cylinders define a negligible but present space between them when the engine is cold.

4. Cylinder block according to claim 1, comprising an upper surface intended to accommodate a head gasket, wherein the upper surface of the cylinder block defines a negligible but present space between two neighboring cylinder sleeves when the engine is cold.

5. Cylinder block according to claim 1, comprising an upper surface intended to accommodate a head gasket, wherein the upper surface of the cylinder block is free of space between two neighboring cylinder sleeves when the engine is warm.

6. Cylinder block according to claim 2, wherein the widening of the top part of the cylinder sleeve is determined so that the top edges of two sleeves lining the cylindrical walls of two neighboring cylinders define a negligible but present space between them when the engine is cold.

7. Cylinder block according to claim 2, comprising an upper surface intended to accommodate a head gasket, wherein the upper surface of the cylinder block defines a negligible but present space between two neighboring cylinder sleeves when the engine is cold.

8. Cylinder block according to claim 2, comprising an upper surface intended to accommodate a head gasket, wherein the upper surface of the cylinder block is free of space between two neighboring cylinder sleeves when the engine is warm.

9. Internal combustion engine comprising a cylinder block according to claim 1 and a cylinder head arranged on the cylinder block, wherein a head gasket is arranged between the cylinder block and the cylinder head, and wherein the top edges of the cylinder sleeves form a continuous surface when the engine is warm so that the head gasket is supported on each of the top edges of the cylinder sleeves.

10. Internal combustion engine according to claim 9, wherein the top part of each of the cylinder sleeves comprises a first, concave annular section followed by a second, convex annular section followed by the straight annular peripheral rim adjoining the top edge.

11. Internal combustion engine according to claim 10, wherein the first annular section, the second annular section and the peripheral rim have approximately a same length in a direction of a main longitudinal axis of the cylinder sleeve.

12. Cylinder block according to claim 1, wherein the top part of each of the cylinder sleeves comprises a first, concave annular section followed by a second, convex annular section followed by the straight annular peripheral rim adjoining the top edge.

13. Cylinder block according to claim 12, wherein the first annular section, the second annular section and the peripheral rim have approximately a same length in a direction of a main longitudinal axis of the cylinder sleeve.

* * * * *

UNITED STATES PATENT AND TRADEMARK OFFICE

CERTIFICATE OF CORRECTION

PATENT NO. : 8,695,558 B2
APPLICATION NO. : 11/993845
DATED : April 15, 2014
INVENTOR(S) : Reymond et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1605 days.

Signed and Sealed this
Twenty-ninth Day of September, 2015

Michelle K. Lee

Michelle K. Lee
*Director of the United States Patent and Trademark Office*